US009587455B2

(12) United States Patent
Frey et al.

(10) Patent No.: US 9,587,455 B2
(45) Date of Patent: Mar. 7, 2017

(54) PISTON ACCUMULATOR BLADDER APPARATUS SYSTEM AND METHOD

(71) Applicants: Tom Frey, Houston, TX (US); Doug Compton, Houston, TX (US); Nathan Schmidt, Houston, TX (US)

(72) Inventors: Tom Frey, Houston, TX (US); Doug Compton, Houston, TX (US); Nathan Schmidt, Houston, TX (US)

(73) Assignee: Reel Power Licensing Corp., Oklahoma City, OK (US)

( * ) Notice: Subject to any disclaimer, the term of this patent is extended or adjusted under 35 U.S.C. 154(b) by 0 days.

(21) Appl. No.: 15/092,746

(22) Filed: Apr. 7, 2016

(65) Prior Publication Data

US 2016/0305212 A1 Oct. 20, 2016

Related U.S. Application Data

(60) Provisional application No. 62/147,705, filed on Apr. 15, 2015.

(51) Int. Cl.
*E21B 33/064* (2006.01)
*F15B 1/24* (2006.01)

(52) U.S. Cl.
CPC ..... *E21B 33/064* (2013.01); *F15B 1/24* (2013.01)

(58) Field of Classification Search
CPC ..... E21B 33/0355; E21B 33/064; F15B 1/24
See application file for complete search history.

(56) References Cited

U.S. PATENT DOCUMENTS

| | | | | |
|---|---|---|---|---|
| 2,406,197 | A * | 8/1946 | Christensen | F15B 1/24 138/31 |
| 2,504,184 | A | 4/1950 | Dawson | |
| 2,721,580 | A | 11/1950 | Greer | |
| 2,720,220 | A * | 10/1955 | Gratzmuller | F15B 1/24 138/31 |
| 4,413,652 | A | 11/1983 | Allewitz | |
| 4,432,393 | A | 2/1984 | Mills | |
| 6,202,753 | B1 * | 3/2001 | Baugh | E21B 33/0355 166/364 |
| 7,520,129 | B2 | 4/2009 | Springett | |
| 9,140,090 | B2 * | 9/2015 | Van Wijk | E21B 33/0355 |
| 2004/0108008 | A1 | 6/2004 | Baugh | |
| 2012/0216900 | A1 * | 8/2012 | Liermann | B60T 13/14 138/31 |

(Continued)

FOREIGN PATENT DOCUMENTS

GB 1108551 4/1968

OTHER PUBLICATIONS

GPM Controls LLC, Schrupp Hydraulic Accumulators, catalogue, gpmcontrols.com, date unknown, Carlisle, PA.

(Continued)

*Primary Examiner* — Matthew R Buck
*Assistant Examiner* — Aaron Lembo
(74) *Attorney, Agent, or Firm* — Phillips Murrah PC; Martin G. Ozinga

(57) ABSTRACT

The present invention is a new and improved bladder for use with a piston accumulator apparatus, system and method of using same that provides a dispersion tube in the bladder to allow fluid to be communicated under a vacuum from the bladder to the accumulator seawater chamber and back again.

5 Claims, 4 Drawing Sheets

(56) References Cited

U.S. PATENT DOCUMENTS

| | | | | |
|---|---|---|---|---|
| 2013/0019980 | A1 | 1/2013 | Baugh | |
| 2014/0230645 | A1* | 8/2014 | Bauer | F16F 9/365 92/109 |
| 2016/0123356 | A1* | 5/2016 | Jirgal | F15B 1/24 73/168 |

OTHER PUBLICATIONS

Product Catalog, Jun. 15, 2009, pp. 25-27, Accumulators Inc., Houston, TX USA.

* cited by examiner

PISTON ACCUMULATOR BLADDER APPARATUS SYSTEM AND METHOD

CROSS-REFERENCE TO RELATED APPLICATIONS

Priority is claimed from provisional application U.S. Ser. No. 62/147,705 filed on Apr. 15, 2015, and incorporated by reference herein.

BACKGROUND OF INVENTION

1. Field of the Invention

In general, the present invention relates to a device, system and method for subsea piston accumulators utilized with blowout preventers in oil and gas well operations. More particularly, the present invention provides an improved bladder having a dispersion tube to ensure the hydraulic fluid stored in the bladder is communicated into the seawater chamber of the subsea piston accumulators as desired.

2. Description of the Prior Art

As known in the art, a blowout preventer is a large, specialized valve or similar mechanical device, usually installed redundantly in stacks, used to seal, control and monitor oil and gas wells. Blowout preventers were developed to cope with extreme erratic pressures and uncontrolled flow, often referred to as a formation kick, emanating from a well reservoir during drilling. Kicks can lead to a potentially catastrophic event known as a blowout. In addition to controlling the downhole pressure occurring in the drilled hole and the flow of oil and gas, blowout preventers are intended to prevent tubing such as drill pipe and well casing, tools and drilling fluid from being blown out of the wellbore when a blowout threatens.

A typical subsea deep-water blowout preventer system includes hydraulic accumulators module that maintains the hydraulic fluid pressures needed to actuate valves on the blow out preventer. A subsea accumulator stores hydraulic fluid under pressure and must release the hydraulic fluid on demand to provide fast closure of the preventers and for cycling all critical components. The fluid to be pressurized is typically an oil-based product or a water based product with added lubricity and corrosion protection. Accumulators with a piston typically have a piston sliding up and down a seal bore to separate the fluid from the gas.

It is also known that a depth compensated piston accumulator must maintain a constant working fluid pressure in the working fluid chamber at any depth. At the surface, the nitrogen chamber is charged to a specific pressure, which exerts a force on top of the piston, which in turn pressurizes the working hydraulic fluid on the other side of the piston. As the accumulator is lowered deeper into the ocean, the ambient seawater pressure squeezes the hydraulic fluid in the bladder to the same pressure. This seawater pressure from the bladder is exerted on top of the piston in the seawater chamber. Essentially, all of the pressure force that is lost from the nitrogen due to the increased water pressure in very deep water is regained by directing that ambient pressure to the seawater chamber.

Furthermore, when the working fluid chamber is full with the working fluid, the seawater chamber hydraulic fluid is stored in the bladder. In this situation, the bladder is completely full. When the working fluid is expelled from the working fluid chamber, the seawater chamber is filled with the hydraulic fluid from the bladder. It is desirable that the seawater chamber fill completely, which is a function dependent on the bladder performance.

The bladder must communicate fluid to the seawater chamber as needed as well as receive fluid from the seawater chamber. A known problem is ensuring that the hydraulic fluid is able to get into the seawater chamber from the bladder. As the piston moves and the volume in the seawater chamber increases, the fluid from the bladder is sucked into the seawater chamber. If fluid is not transferred, a vacuum will be pulled into the chamber and the depth compensation function will fail.

It is known that bladders are typically made for a nylon material and also provided with a liner. It is also known in the prior art devices for the liner to collapse inside the bladder when fluid is being sucked into the seawater chamber. This may impede the flow of the fluid and prevent the accumulator from working properly and or as efficiently.

Thus, there is a need for an apparatus, process and or system that provides a functioning bladder system for use with a subsea piston accumulator. It is desirable to fill these needs with reliable technology that are affordable and attractive to accumulator operations associated with blow out preventers. The above discussed limitations in the prior art is not exhaustive. The current invention provides an inexpensive, time saving, more reliable apparatus, method and system bladder functionality where the prior art fails.

SUMMARY OF THE INVENTION

In view of the foregoing disadvantages inherent in the known types of bladders utilized with piston accumulators now present in the prior art, the present invention provides a new and improved apparatus, system and method of use that provides better bladder performance. As such, the general purpose of the present invention, which will be described subsequently in greater detail, is to provide a new and improved bladder for use with subsea piston accumulators for blow out preventers, which has all the advantages of the prior art devices and none of the disadvantages.

It is, therefore, contemplated that the present invention is an apparatus, system and method for improved bladder for use with subsea piston accumulators having a dispersion tube to ensure that hydraulic fluid stored in the bladder is sucked into the seawater chamber of the accumulator. The tube is ported allowing fluid to constantly be supplied to the chamber regardless of the fluid depth in the bladder. The invention also contemplates a special foot allowing the accumulator and bladder to be shipped in a horizontal position preventing the bladder and dispersion tube from being damaged and may further include a bladder cradle to distribute the weight of the fluid in the bladder reducing the stress on the fitting where the bladder foot is installed.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in this application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide a new and improved piston accumulator bladder apparatus, system and method for use in subsea piston accumulators that provides fluid as desired to the accumulator seawater chamber.

Furthermore, an object of the present invention is to provide a new and improved piston accumulator bladder apparatus, system and method, which allows for transmitting fluids utilizing a ported dispersion tube to allow fluid to constantly be supplied to the chamber regardless of the fluid depth in the bladder.

Another object of the present invention is to provide a new and improved piston accumulator bladder apparatus, system and method, which may include a special foot allowing the accumulator and bladder to be shipped in a horizontal position preventing the bladder and dispersion tube from being damaged and a bladder cradle designed to distribute the weight of the fluid in the bladder reducing the stress on the fitting where the bladder foot is installed.

It is a further object of the present invention to provide a new and improved piston accumulator bladder apparatus, system and method, which is of a durable and reliable construction and may be utilized in numerous types of piston accumulators.

An even further object of the present invention is to provide a new and improved piston accumulator bladder apparatus, system and method, which is susceptible to a low cost of installation and labor, which accordingly is then susceptible to low prices of sale to the consuming industry, thereby making such a system economically available to those in the field.

Still another object of the present invention is to provide a new and improved piston accumulator bladder apparatus, system and method, which provides all of the advantages of the prior art while simultaneously overcoming some of the disadvantages normally associated therewith.

These, together with other objects of the invention, along with the various features of novelty, which characterize the invention, are pointed out with particularity in the claims annexed to and forming a part of this disclosure. For a better understanding of the invention, its operating advantages, and the specific objects attained by its uses, reference should be had to the accompanying drawings and descriptive matter in which there are illustrated preferred embodiments of the invention.

BRIEF DESCRIPTION OF THE PICTORIAL ILLUSTRATIONS, GRAPHS, DRAWINGS, AND APPENDICES

The invention will be better understood and objects other than those set forth above will become apparent when consideration is given to the following detailed description thereof. Such description makes reference to the annexed pictorial illustrations, graphs, drawings and appendices.

DETAILED DESCRIPTION OF INVENTION

Figure 1:
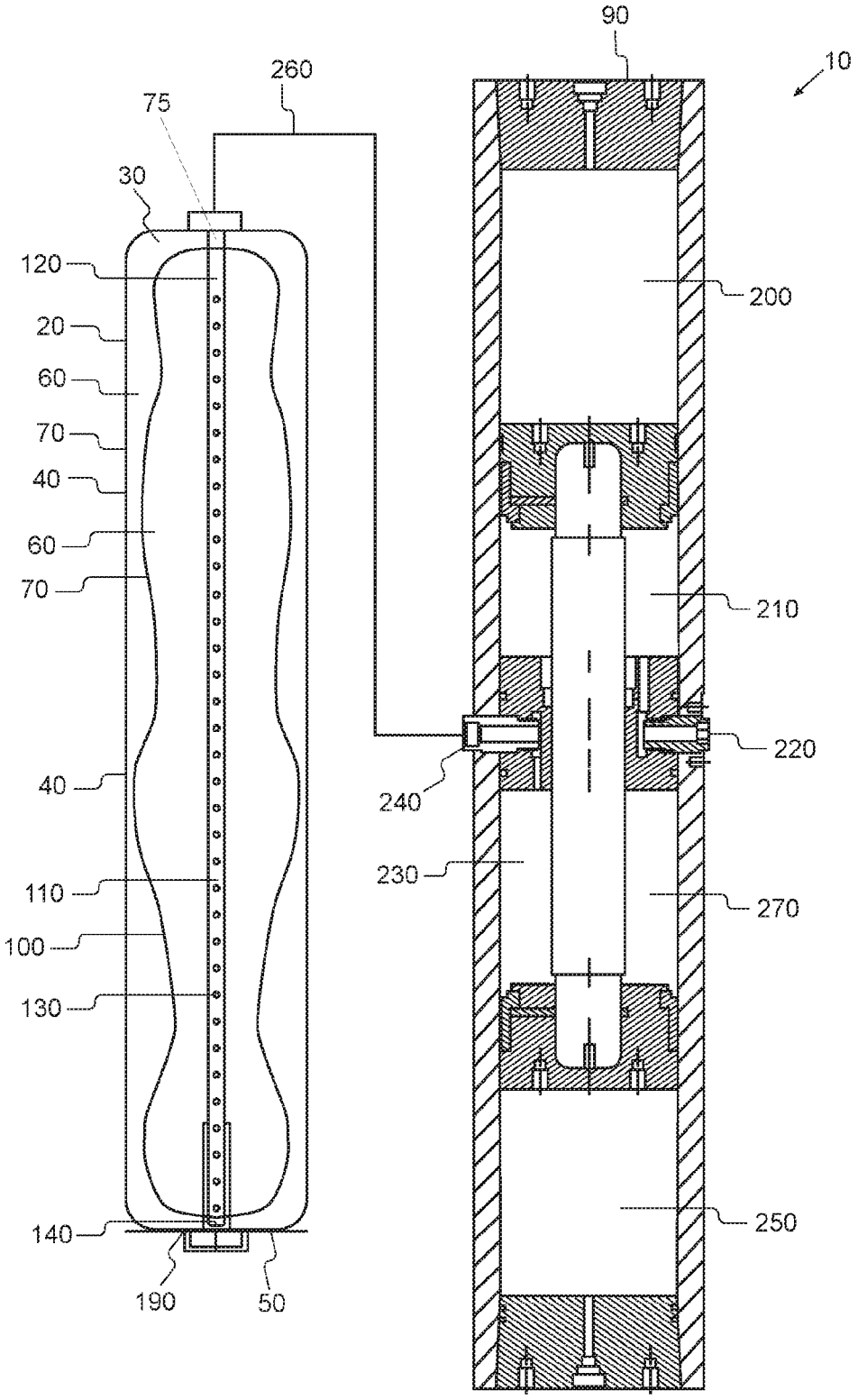
FIG. 1 is a general cross section illustration of a subsea piston accumulator and bladder system of a preferred embodiment in accordance with the invention.
Figure 2:
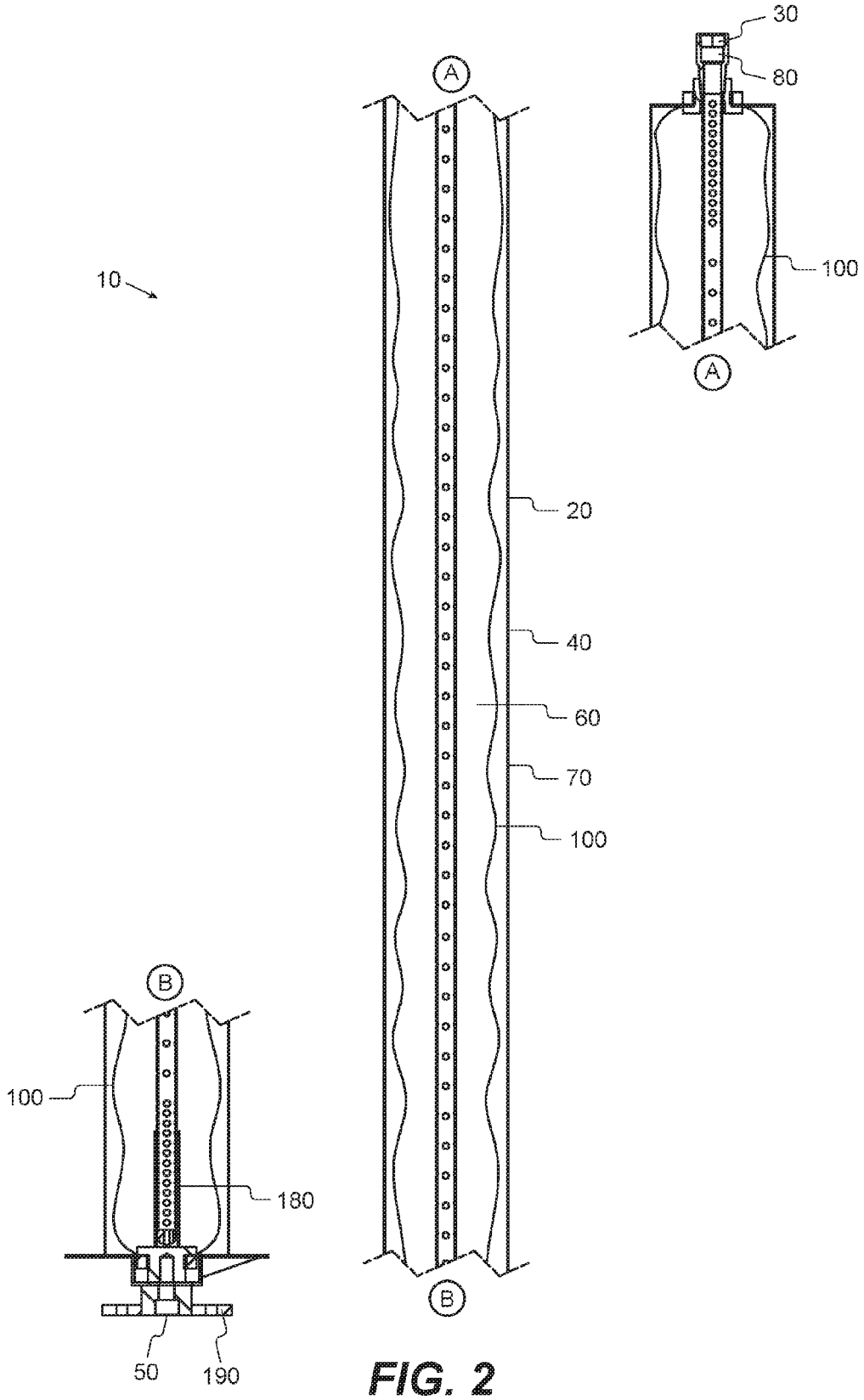
FIG. 2 is a general cross section illustration of a bladder of a preferred embodiment in accordance with the invention.
Figure 3:
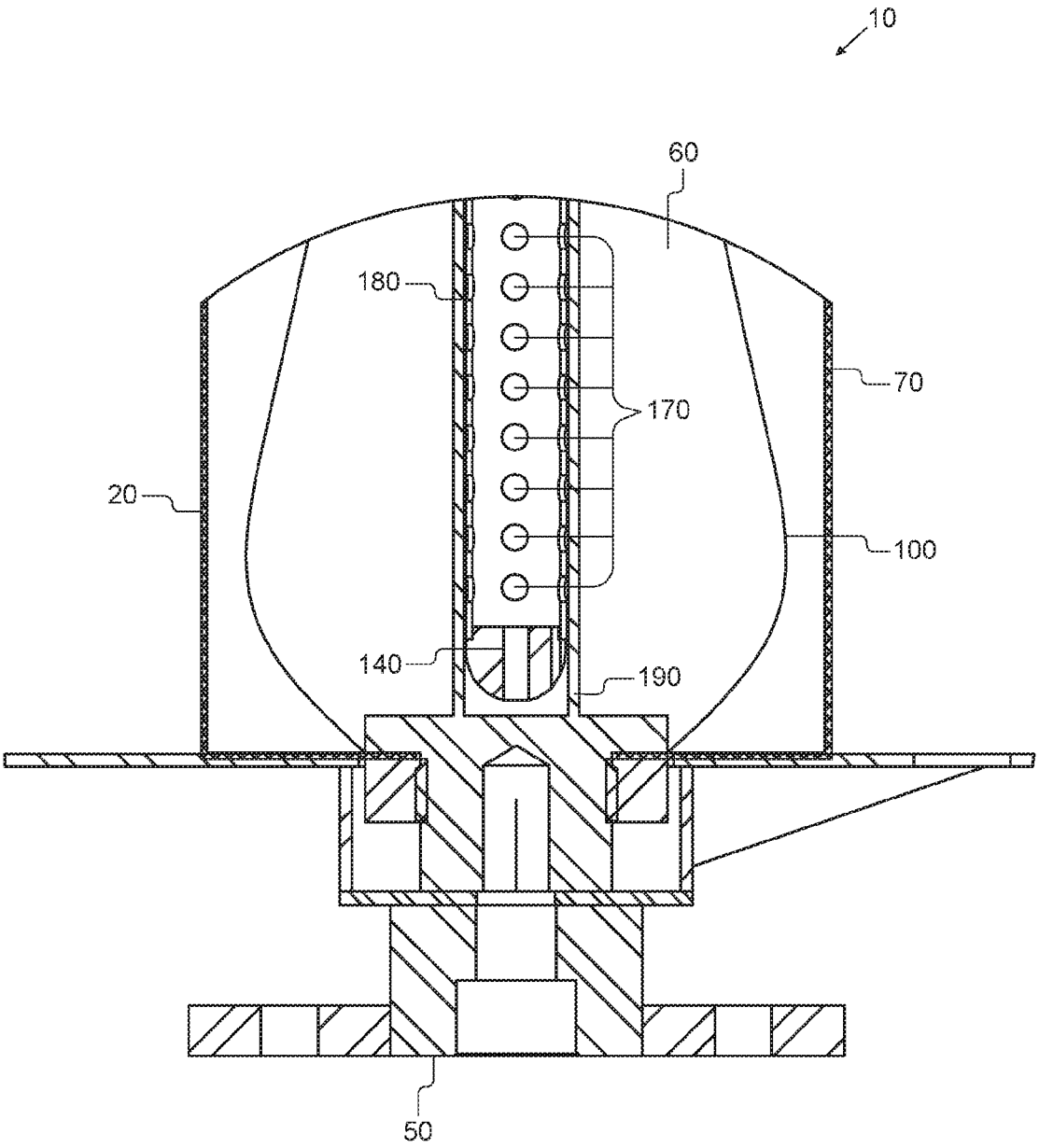
FIG. 3 is a general cross section partial illustration of a lower portion of a bladder of a preferred embodiment in accordance with the invention.
Figure 4:
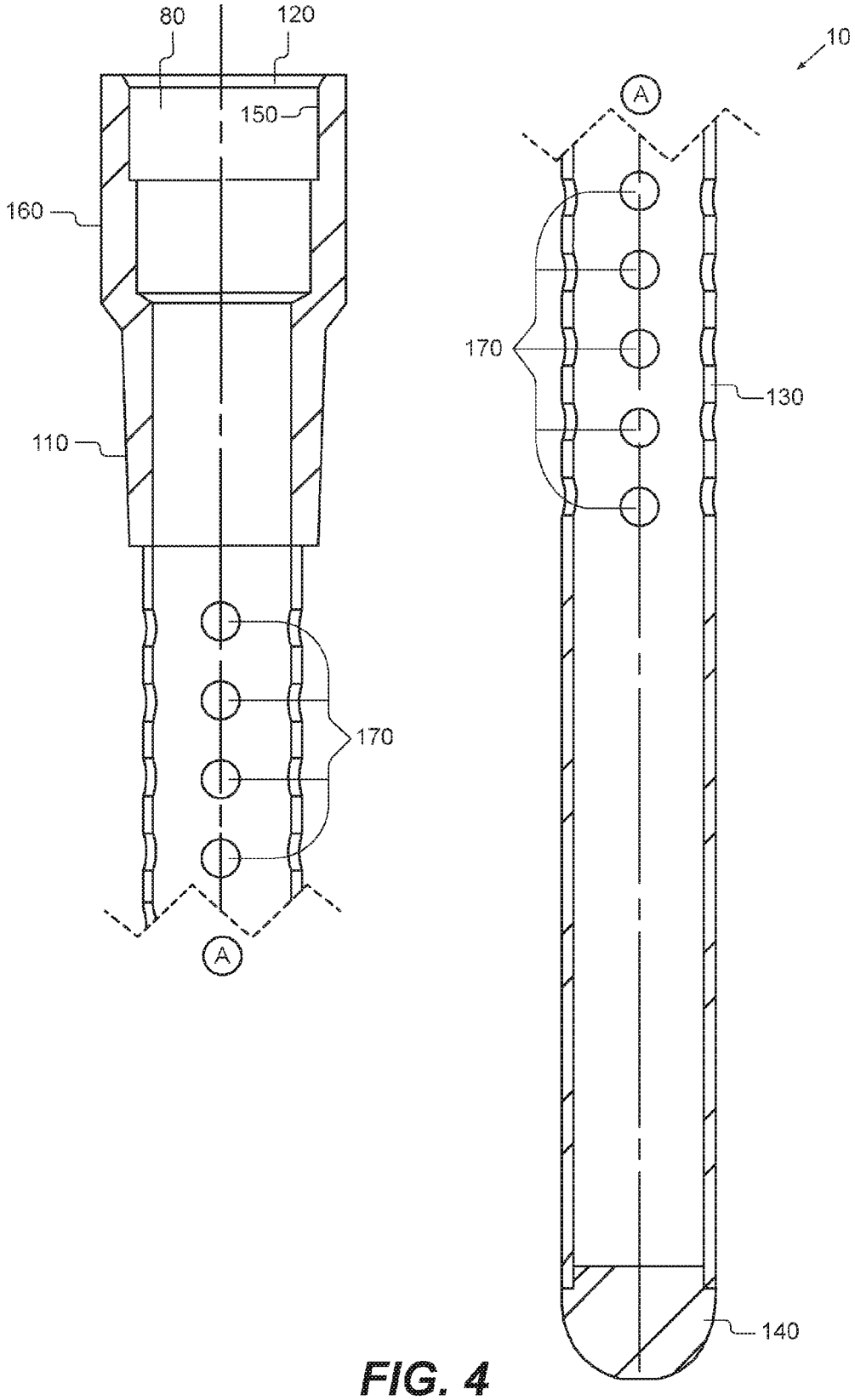
FIG. 4 is a general cross section illustration of a dispersion tube of a preferred embodiment in accordance with the invention.

Referring to the illustrations, drawings, and pictures, and to FIG. 1 in particular, reference character 10 generally designates a new and improved bladder for use with a piston accumulator apparatus, system and method of using same constructed in accordance with the present invention. Invention 10 is generally used in oil and gas well operations such as but not limited to blow out preventers and may be utilized in other operations not associated with oil and gas drilling operations. For purposes of convenience, the reference numeral 10 may generally be utilized for the indication of the invention, portion of the invention, preferred embodiments of the invention and so on. It is also to be understood that invention 10 should not be considered limited to an improved bladder and the term bladder should not be considered to limit the invention to such. Invention 10 may also include a new and improved accumulator apparatus, system and method as well as new and improved blowout preventer apparatus, system and method.

Bladder 20 may include a top 30, a length 40, a bottom 50, an interior 60, an exterior 70, and outlet 80 for communicating fluid to subsea piston accumulator 90. Bladder 20 may be made from nylon but is not limited to such. It is understood that bladder 20 may be elastomeric and or somewhat elastomeric to compress and expand depending on ambient subsea water pressure. Bladder 20 may include a liner 100 such as but not limited to plastic. Liner 100 generally lines the interior 60 of bladder 20.

Invention 10 may include a dispersion tube 110 having a top 120, a length 130, a bottom 140, an interior and or inner diameter 150, an exterior and or outer diameter 160, and so forth. Tube 110 may be made of stainless but is not limited to same. Length 130 may be 16 feet, interior diameter 150 may be about 1 inch, and outer diameter 160 may be an inch. It is understood that lengths, sizes, shapes and so forth may be larger and or smaller and the current invention 10 should not be considered limited to the illustrations and examples. Tube 110 may not necessarily be a round tube configuration and may be square, triangular and so forth. Tube 110 may include holes 170, which may be drilled out and relatively small such as a ¼ inch but is to be understood that larger size, configuration and arrangement is contemplated.

Invention 10 dispersion tube 110 generally provides a structure wherein bladder 20 and or liner 100 may have a passageway for fluid to travel the length of bladder 20 even if part of liner 100 and bladder 20 collapse and impedes fluid flow when fluid is being moved to accumulator 90.

Invention 10 contemplates generally fixing tube 110 inside bladder 20 liner 100 wherein top 120 of tube 110 is fixed at top 30 of bladder 20 and in communication 75 with outlet 80. Communication 75 may be a hose, line, conduit and so forth as known in the art. Furthermore, tube 110 bottom 140 may be fixed at bladder 20 bottom 50. In a preferred construction, 110 may be threaded at top 120 for securing to outlet 80. Bottom 140 of tube 110 may be fixed by sliding in a foot 180, which may be a larger diameter tube fixed by a bladder cradle 190. It is understood that numerous other embodiments are contemplated to generally secure tube 110. In a preferred construction, invention 10 may utilize cradle 190, which may be fixed at bottom 50 of bladder 20 for supporting tube 110 during transportation and movement in general.

Accumulator 90 is known in the art and may include a nitrogen chamber 200, working fluid chamber 210, working fluid port 220, seawater chamber 230, seawater port 240, a vacuum chamber 250, and so forth. Conduit 260 may be between bladder 20 and seawater port 240 for communicating fluid 270 back and forth from bladder 20 to seawater chamber 230.

It is therefore contemplated that the current invention may be a subsea piston accumulator and bladder system comprising: a subsea piston accumulator having a seawater port for selectively communicating liquid into and out of said subsea piston accumulator; a bladder having an interior and an aperture for communicating said liquid into and out said interior of said bladder; a liner disposed in said interior of said bladder, said liner having an interior adapted to hold said fluid and wherein said liner has an aperture for communicating said fluid into and out of said interior of said liner; and a dispersion tube a disposed in said liner, said dispersion tube having a first end with an aperture for communicating said fluid into and out of said dispersion tube, a length, a second end, and a plurality of apertures on said length adapted to communicate said liquid into and out of said dispersion tube and into and out of said interior of said liner.

It is also contemplated that the current invention may be a subsea piston accumulator and bladder system comprising wherein said second end of said dispersion tube is removably attached to said interior of said bladder via a cradle mounted to said interior of said bladder; wherein said cradle includes a foot adapted to allow said second end of said dispersion tube to slide into said foot; wherein said first end of said dispersion tube is fixed to said interior of said bladder; and wherein said second end of said dispersion tube is rounded.

Changes may be made in the combinations, operations, and arrangements of the various parts and elements described herein without departing from the spirit and scope of the invention. Furthermore, names, titles, headings and general division of the aforementioned are provided for convenience and therefore, should not be considered limiting.

What is claimed is:

1. A subsea piston accumulator and bladder system comprising:

a subsea piston accumulator having a seawater port for selectively communicating hydraulic fluid into and out of said subsea piston accumulator;

a conduit having a first end connected to said seawater port and a second end;

a bladder having an interior and a bladder aperture connected to said second end of said conduit for communicating said hydraulic fluid into and out said interior of said bladder;

a liner disposed in said interior of said bladder, said liner having an interior adapted to hold said hydraulic fluid and wherein said liner has a liner aperture for communicating said hydraulic fluid into and out of said interior of said liner; and a dispersion tube disposed in said liner, said dispersion tube having a first end with a first end aperture for communicating said hydraulic fluid into and out of said dispersion tube, a length, a second end, and a plurality of dispersion tube apertures on said length adapted to communicate said hydraulic fluid into and out of said dispersion tube and into and out of said interior of said liner.

2. The system of claim 1 wherein said second end of said dispersion tube is removably attached to said interior of said bladder via a cradle mounted to said interior of said bladder.

3. The system of claim 2 wherein said cradle includes a foot adapted to allow said second end of said dispersion tube to slide into said foot.

4. The system of claim 3 wherein said first end of said dispersion tube is fixed to said interior of said bladder.

5. The system of claim 3 wherein said second end of said dispersion tube is rounded.

* * * * *